US005421489A

United States Patent [19]

Holzner, Sr. et al.

[11] Patent Number: 5,421,489

[45] Date of Patent: Jun. 6, 1995

[54] PUSH-TYPE SOAP DISPENSER

[75] Inventors: Charles R. Holzner, Sr., Chicago; Brian Phillips, Joliet, both of

[73] Assignee: Steiner Company, Inc., Chicago, Ill.

[21] Appl. No.: 180,377

[22] Filed: Jan. 12, 1994

[51] Int. Cl.[6] ..... B65D 35/28

[52] U.S. Cl. ..... 222/207; 222/325; 222/181

[58] Field of Search ..... 222/207, 181, 185, 209, 222/214, 325

[56] References Cited

U.S. PATENT DOCUMENTS

| | | | |
|---|---|---|---|
| 4,018,363 | 4/1977 | Cassia | 222/325 X |
| 4,149,573 | 4/1979 | Cassia | 222/207 X |
| 4,345,627 | 8/1982 | Cassia | 222/325 X |
| 4,429,812 | 2/1984 | Steiner et al. | 222/181 |
| 4,667,854 | 5/1987 | McDermott et al. | 222/181 X |
| 4,673,109 | 6/1987 | Cassia | 222/181 X |
| 4,830,227 | 5/1989 | Ball et al. | 222/209 X |
| 4,961,508 | 10/1990 | Weimer et al. | 222/207 X |
| 5,207,355 | 5/1993 | Thomsen | 222/207 X |

FOREIGN PATENT DOCUMENTS

| | | | |
|---|---|---|---|
| 2836635 | 3/1979 | Germany | 222/209 |

*Primary Examiner*—Andres Kashnikow

*Assistant Examiner*—Lisa Douglas

*Attorney, Agent, or Firm*—Emrich & Dithmar

[57] ABSTRACT

A system for dispensing liquid soap including a closed wall structure defining a container with a partition separating the container into a separate lower liquid soap reservoir and a separate upper refill compartment. Dispensing mechanism is carried by the container for dispensing liquid soap from the reservoir. The partition has a refill aperture therethrough providing communication for soap flow between said reservoir and the refill compartment and dimensioned to permit the free flow of liquid soap therethrough. A refill cartridge of liquid soap has an outlet, removably enclosed within the refill compartment in a refill configuration with the outlet disposed for cooperation with the refill aperture to permit the free flow of liquid soap from the refill cartridge to the reservoir thereby to refill the reservoir as liquid soap is dispensed therefrom. Actuating mechanism is slidably mounted on the container in pivotable contact with the dispensing means with the actuating mechanism being slidable between a rest position and a dispensing position such that not greater than five pounds of pressure is sufficient to move the actuating mechanism between the rest and dispensing positions thereof.

10 Claims, 4 Drawing Sheets

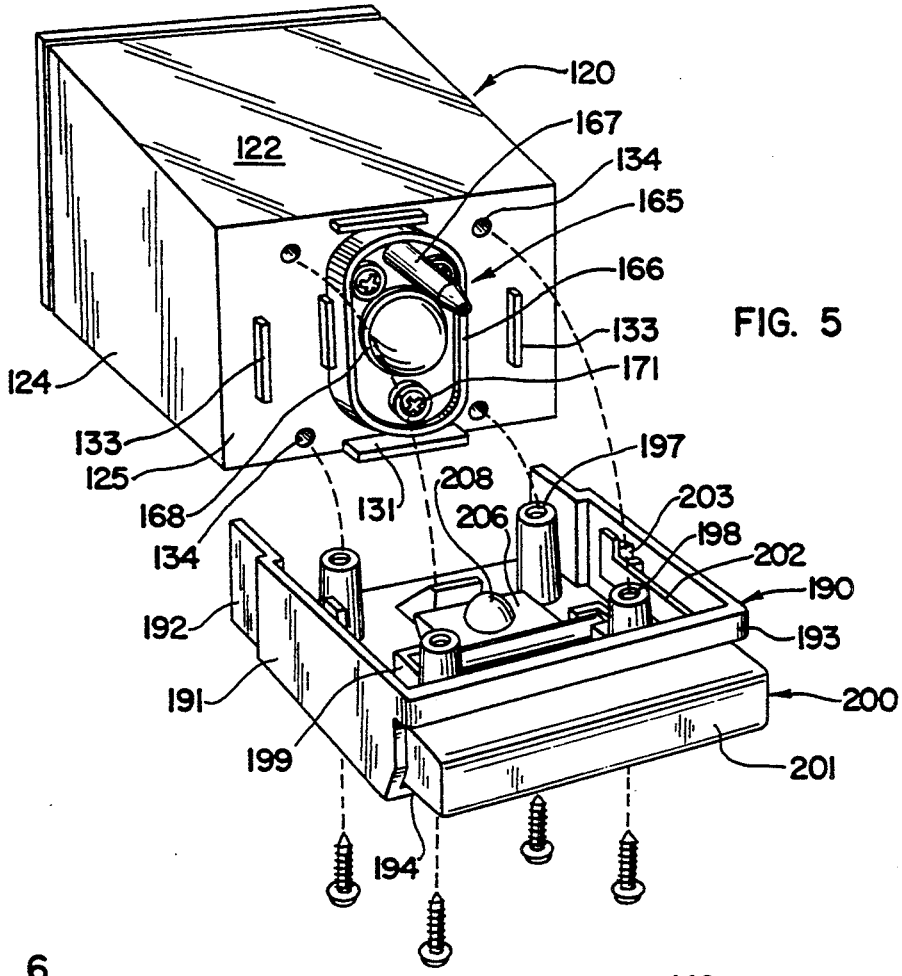
FIG. 5
FIG. 6
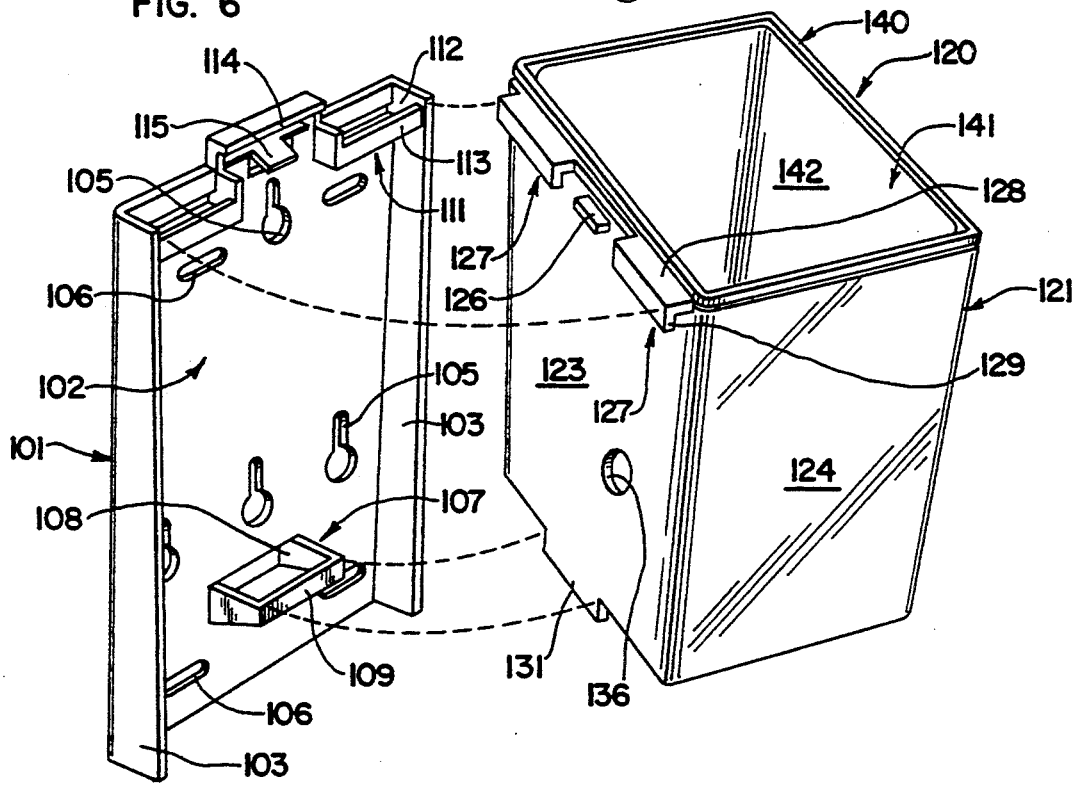

PUSH-TYPE SOAP DISPENSER

BACKGROUND OF THE INVENTION

The present invention relates to apparatus for dispensing liquid soap, normally in discrete small quantities or charges. Such dispensing apparatus is used, particularly for hygienic purposes, in public or institutional washrooms or the like or wherever there are a relatively large number of different users.

One such dispenser is disclosed in U.S. Pat. No. 4,149,573, assigned to the assignee of the present invention, the disclosure of which is incorporated by reference, and of which the present invention is an improvement. In the system of the '573 patent, a container is provided with a refill aperture which is dimensioned so that at equal pressures inside and outside said container liquid soap will flow therethrough only very slowly if at all. Thus, in refilling the container, a special squeeze-bottle type refill cartridge is used in order to force the soap through the refill aperture, the cartridge outlet being closed by a pierceable membrane which is ruptured by a piercing member adjacent to the refill aperture to permit the flow of liquid soap from the refill cartridge.

Another dispenser disclosed in U.S. Pat. No. 4,345,627, assigned to the assignee of the present invention, the disclosure of which is incorporated by reference, teaches a dispenser which used a refill cartridge in the reservoir of the dispenser. This was a significant change and also an important commercial improvement. With the advent of the American Disabilities Act, there is now a requirement that at least one soap dispenser in all public washrooms must be able to be operated with less than five pounds of force and must be able to be operated by a disabled person with damaged hands or fingers. The soap dispensing systems taught in the patents referred to above as well as in U.S. Pat. No. 4,018,363 also assigned to the assignee of the present invention, the disclosure of which is incorporated by reference, all require a pulling action in access of five pounds of force. Accordingly, the prior inventions while commercially very important, were not capable of meeting the present requirements of the American Disabilities Act.

SUMMARY OF THE INVENTION

Therefore, it is a general object of this invention to provide a liquid soap dispensing system, which includes a refillable dispenser, and which avoids the disadvantages of prior art dispensing systems while affording additional structural and operating advantages, and complies with the American Disabilities Act.

It is another object of the invention to provide a soap dispensing system of the type set forth which accommodates free flow of the liquid soap from the refill cartridge through the refill aperture into the soap reservoir of the container.

Still another object of the invention is the provision of a liquid soap dispensing system of the type set forth, wherein the refill operation requires very little of a serviceman's time.

Another object of the invention is the provision of a liquid soap dispensing system which includes a refillable liquid soap container having a refill compartment therein in which a refill cartridge may be enclosed and left in place or may be used as a bulk dispenser.

Another object of the invention is to provide a liquid soap dispensing system in which the soap doses are dispensed by means of a push bar actuator which extends forwardly of the dispenser to an extent sufficient to enable a person with disabled fingers or hands to operate the dispenser.

Further features of the invention pertain to the particular arrangement of the parts of the liquid soap dispensing system whereby the above-outlined and additional operating features thereof are attained.

The invention, both as to its organization and method of operation, together with further objects and advantages thereof, will best be understood by reference to the following specification taken in connection with the accompanying drawings.

BRIEF DESCRIPTION OF THE DRAWINGS

FIG. 5 is a view of the soap container and bottom housing of the dispenser illustrated in FIG. 4 with the soap container being rotated 90° to illustrate the bottom components thereof; and FIG. 6 is a view of the soap container and mounting plate illustrated in FIG. 4 with the soap container being rotated 90° to the right in order to facilitate an understanding of the mounting of the soap cartridge holder and soap container to the mounting place.

DESCRIPTION OF THE PREFERRED EMBODIMENT

Figure 1:
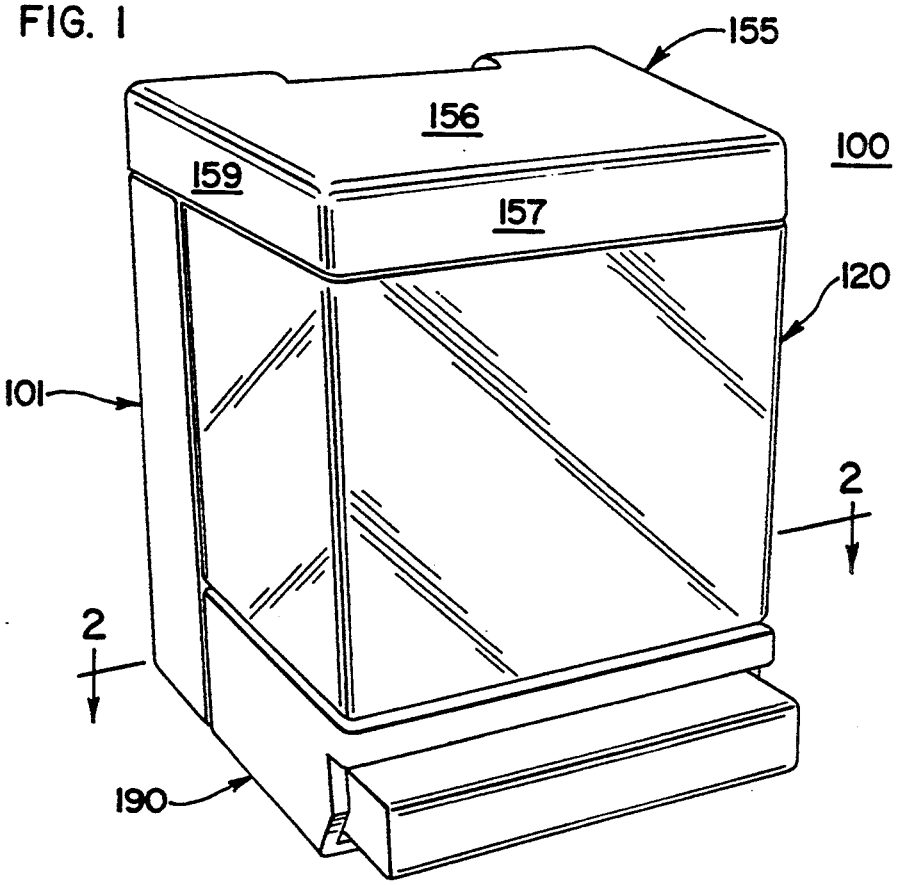
FIG. 1 is a perspective view of the liquid soap dispenser constructed in accordance with and embodying the features of the present invention.
Figure 2:
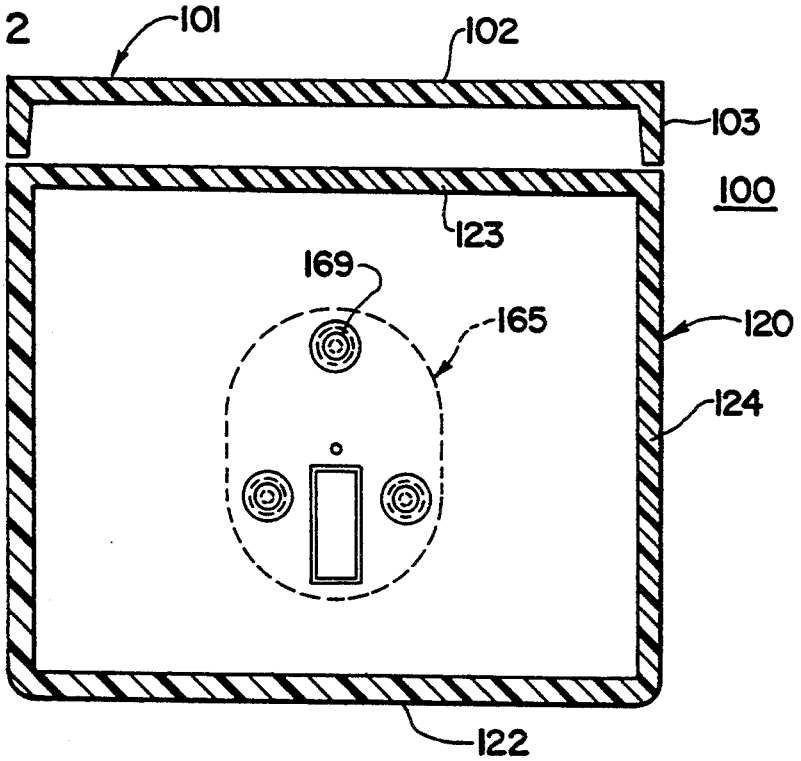
FIG. 2 is an enlarged view in horizontal section taken along line 2—2 of FIG. 1.

Referring now to the drawings, there is disclosed a soap dispenser 100 constructed in accordance with and embodying the features of the present invention. The soap dispenser 100 includes a mounting bracket 101 which includes a generally flat rectangular flat plate 102 disposed substantially vertical in use to provide a bearing surface, and having along each of the side edges thereof, an integral curved side flange or wall 103 which projects forwardly from the flat plate 102. Formed in the vertical wall or flat plate 102 are a plurality of keyhole shaped mounting apertures 105 and a plurality of oval mounting slots 106 spaced in the flat plate 102 to provide a variety of mounting apertures for the dispenser 100. Also formed in the wall or flat plate 102 is a mounting receptacle 107 disposed centrally but toward the bottom of the mounting bracket 101 having forwardly extending sides 108 and a front retaining wall 109, all for a purpose to be described.

At the top of the mounting bracket 101 are a pair of retaining members 111 formed at the juncture of the side walls 103 and the flat plate 102 and extending centrally of the flat plate 102. The retaining members 111 each has an opening 112 between a front wall 113 and the back of the mounting bracket 101 between the retaining members 111 and slightly above them is a forwardly extending abutment ledge or surface 114 and a tongue 115 for a purpose hereinafter set forth.

In use, the mounting bracket 101 is mounted on a wall generally above and closely adjacent the sink, wash basin or the like. Mounting openings or apertures 105 and 106 may have screw fastening inserts therein (not shown), or may be used by other normal means to mount the dispenser 100 on the wall. Some times an adhesive (not shown), is provided on the back surface of the mounting bracket 101 to be enable the dispenser 100 to be adhesively secured to a wall if desired.

The dispenser 100 also includes a soap container or housing 120 which is generally formed of a translucent or transparent plastic, although it will be understood that any suitable material, either opaque or light transmitting could be used. The container 120 is generally box like in configuration and includes a generally parallelepiped container 121 having a rectangular front and rear wall 122 and 123, respectively, joined and integral with the side walls 124 and a bottom 125. As seen particularly in FIG. 3, the rear wall 123 is provided at the upper end thereof with a centrally located rearwardly extending tab (see FIG. 6), and a pair of latches 127 on either side of the central tab 126, each of the latches 127 comprising a rearwardly extending spacer portion 128 and a downwardly extending tongue portion 129. At the bottom of the rear wall 123 of the soap container 120 is a central tongue 131 which extends below the bottom 125 of the dispenser. Extending downwardly from the bottom 125 on the outside of the soap container 120 are a pair of spacers 133 and a plurality of internally tapped cylinders 134 extending inwardly of the bottom wall 125 to mount mechanism thereto that will be explained. An opening 136 is in the rear wall 123 and a cover plate 137 forms a passageway 138 which is segregated from the inside of the soap container 120, all for a purpose hereinafter set forth.

Figure 4:
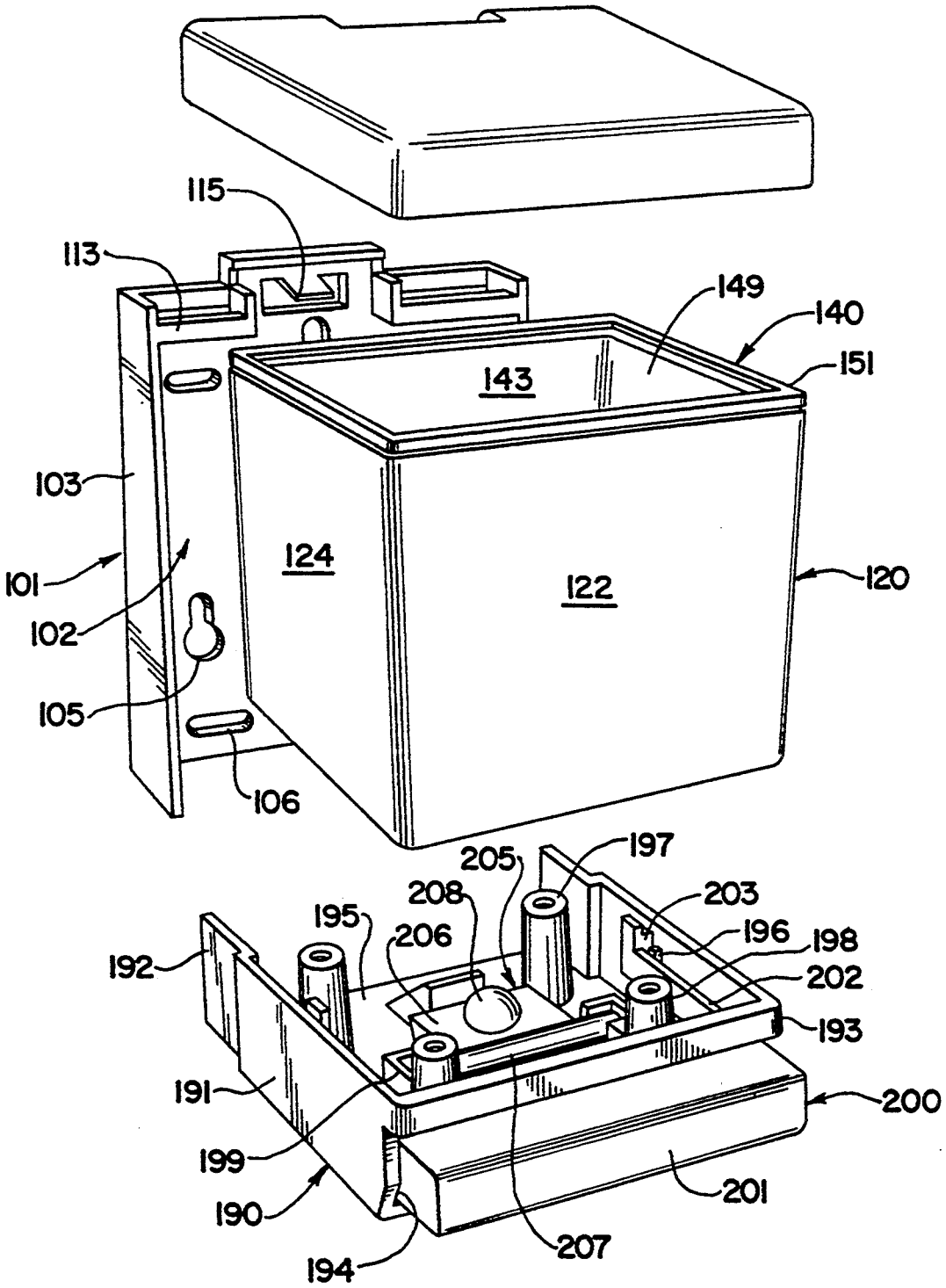
FIG. 4 is an exploded front perspective view of the liquid soap dispenser illustrated in FIG. 1 without a cartridge.

A soap cartridge holder 140 includes a generally parallelepiped container 141 having opposed generally rectangular front and rear walls 142 and 143, respectively, integrally connected by a bottom 144 and sides 149 (see FIG. 4). A well 145 is integrally formed with the bottom 144 and extends downwardly therefrom and includes an upwardly extending piercing member 146 having a bevelled edge 147. A plurality of apertures 148 in the bottom of the well 145 provide communication between the soap cartridge holder 140 and the soap container 120. At the top of the soap cartridge holder 140 an outwardly extending lip 151 is integrally formed with the parallelepiped member 141 and fits upon the top of the corresponding soap container 120 so that the soap cartridge holder 140 is left inside the soap container 120. A plurality of slots 152 are provided in the soap cartridge holder 140 near the top thereof for latching purposes to be described.

Figure 3:
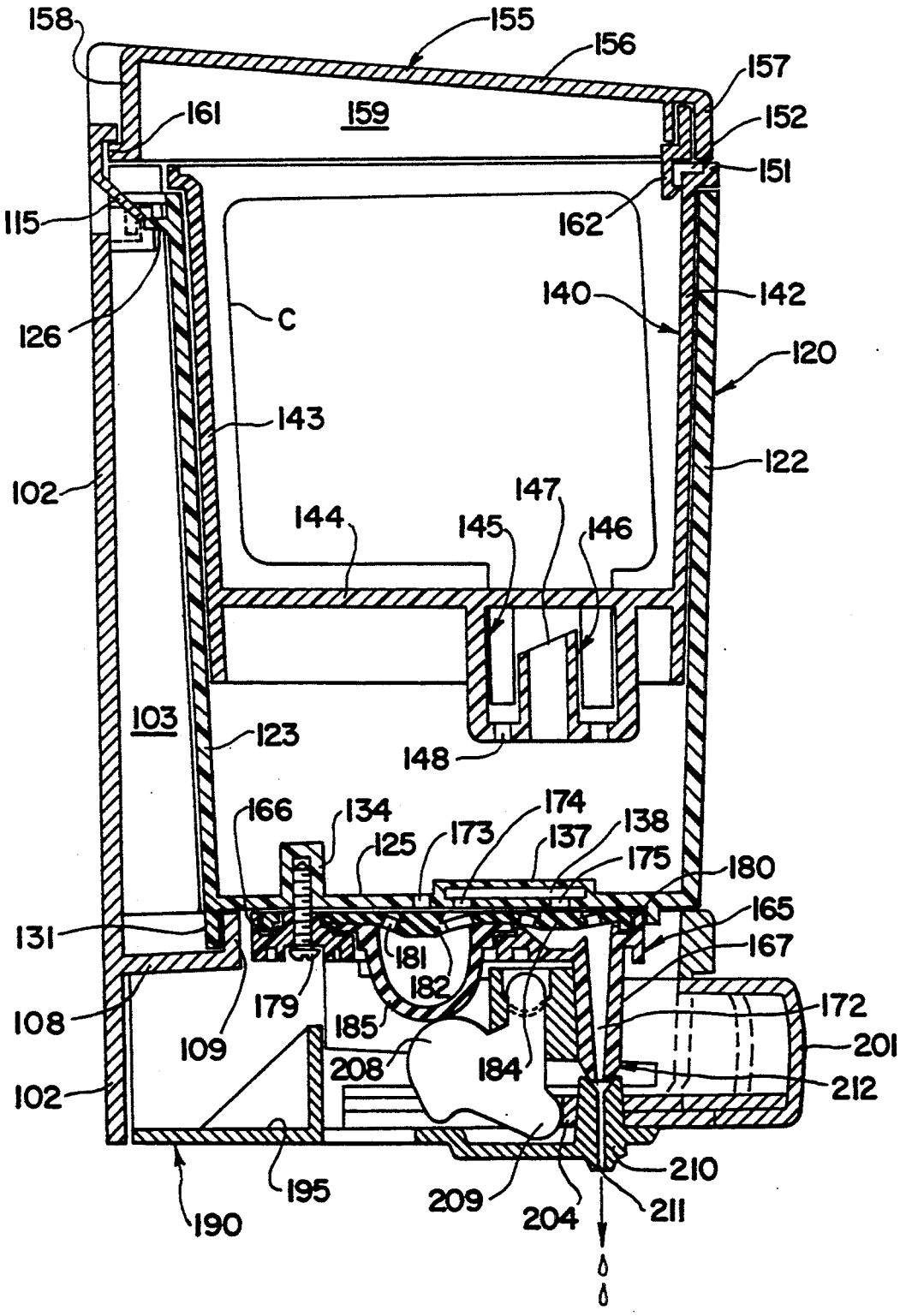
FIG. 3 is a view in vertical section of the soap dispenser illustrated in FIG. 1 illustrating the internal construction of the soap dispenser with a cartridge in place.

A soap C, as seen in FIG. 3 and disclosed in U.S. Pat. No. 4,345,627 may be used with the dispenser 100 and fits in holder 140. The bottom 144 of cartridge holder 140 divides the housing or soap container 120 into a lower liquid soap reservoir and an upper and separate refill compartment. The dispenser 100 may be used with a soap refill cartridge C or as a bulk soap dispenser.

The cover 155 includes a top member 156 which is constructed to fit over and to cover the soap cartridge holder 140, the cover 155 having a top member 156 and front panel 157, rear panel 158 interconnected by side panels 159. A rearwardly extending lip 161 extends from the bottom of the rear panel 158 and a downwardly extending latch member 162 extends downwardly from the front panel 157. The cover 155 is similar to the covers disclosed in the patents previously identified herein, these being U.S. Pat. No. 4,018,363, 4,149,573 and 4,345,627, the disclosures of which have been incorporated by reference.

Similarly, there is provided a pump assembly 165 which is virtually identical to the pump assembly disclosed in the aforementioned patents. The pump assembly 165, as best seen in FIGS. 3 and 5, includes a generally cylindrical pump housing 166 having a downwardly extending nozzle 167 and a large circular opening 168 therein. A plurality of mounting screw openings 169 are positioned in the housing and as illustrated three such openings are provided. Three mounting screws 171 serve to affix the pump assembly 165 to the bottom of the soap container 120 so that soap, as will be described, is able to be dispensed through a route hereinafter set forth from the nozzle 167 and particularly from the delivery conduit 172 inside the nozzle. The bottom 125 of the soap container 120 is provided with a suction opening 173 and two supply openings 174 and 175, these openings being in registry with the pump assembly 165 which overlies the openings 169 which will be explained. It also being understood that the cover 137 overlies the two supply openings 174 and 175 but not the suction openings 173 which is adjacent to but outside of the cover 137.

A flexible diaphragm 180 lies between the bottom 125 of the soap container 120 and the pump assembly 165 and more particularly the pump housing 166 and is trapped therebetween by means of the plurality of mounting screws 171 received in the tapped cylinders 134. The flexible diaphragm 180 is the same as described in the previous patents referred to above, and functions in the same way, the diaphragm having a plurality of suction apertures 181 and a suction obturator 182 spaced from a discharge obturator 184. A flexible bowl 185 surrounds the apertures 181 and the suction apertures 181 and the suction obturator 182. As previously described in the patents referred to above, there is provided by the construction set forth, a path for liquid soap from the inside of the soap container 120 and particularly from the soap reservoir portion thereof to pass through the aperture 173 into the bowl 185 and then through the suction apertures 181 through the aperture 174 into the passageway 138 and then through aperture 178 into the nozzle 167 and hence through the delivery conduit 172, all as previously described in the above-mentioned patents incorporated herein by reference.

A bottom housing or bonnet 190 overlies the bottom of the soap container 120 and encloses same and includes a pair of opposed sides 191 having inset side portions 192 interconnected by a front wall 193 having a large central opening 194 therein, the sides and front being interconnected by a floor 195. A pair of stops 196 are positioned on the inside surface of the sides 191. As shown, four mounting cylinders and spacers are provided two rear mounting cylinders and spacers 197 and two front spacers 198, the front spacers 198 being provided with integrally extending guides or journals 199 extending rearwardly from the associated mounting cylinder 198 and facing each other.

An actuator 200 is slidably mounted on the bottom housing or bonnet 190 and includes a bar 201 which extends substantially the width of the bonnet 190 and has a pair of side members 202 with stops 203 thereon positioned behind the stops 196 on the bonnet sides 191 so as to limit the movement of the actuator bar 201 inwardly and outwardly with respect to the front 193.

The actuator bar 201 carries a pair of inwardly extending prongs 204, see FIG. 3, which are spaced apart and positioned so that one is on each side of a downwardly extending cylindrical dispensing mechanism 205 located substantially in the forward center of the front 195 of the bottom bonnet 190.

A soap dispensing mechanism 205 includes a plate 206 having at the forward end thereof, a transversely extending rod or stub shafts 207 which fits inside the journals 199 extending from the front spacers 198 so as pivotally to mount the dispensing mechanism 205 to the bonnet 190. The plate 206 carries a bulb compressor 208 in the form of a hemisphere, and on the opposite surface of plate 206 downwardly extending spaced apart contact members 209 are aligned with the inwardly extending prongs 204. A soap dispenser 210 has a cylindrical opening 211 extending to the bottom of the bonnet 190 and a funnel 212 in registry with the bottom of the nozzle 172.

Operation of the soap dispenser 100 with the exception of the actuator 200 is exactly the same as previously described in the aforementioned Steiner Company, Inc. patents incorporated herein by reference. The actuator of the present invention is provided to comply with the American Disabilities Act and is operable with less than five pounds of pressure and is positioned with the bar 201 thereof extending forwardly of the bonnet front wall 193. The importance of this configuration is that the actuator 200 is in easy reach of the disabled and because the bar 201 extends substantially the entire width of the dispenser 100 is easy to manipulate for the disabled, even those with disabilities in the hands or fingers.

Another significant advantage of the present invention is that the bar 201 which moves between the rest position as shown in FIG. 4 and the dispensing position shown in dotted line in FIG. 3, always is exterior to front wall 193 of the bonnet 190 even when in the dispensing position thereof. Again, this is an important feature for the disabled.

Because the actuator 200 has both slidable portions and pivoting portions, the dispensing of soap from the bowl or bulb 185 is made easier and in fact is accommodated with less than five pounds of pressure required to move the bar 201 from its rest position as shown in full line in FIG. 3 and its dispensing position shown in dotted line of FIG. 3.

Restating, the mounting of the pieces onto the mounting plate or bracket 101 has previously been described as has been the manner in which the pump assembly 165 operates to provide discrete doses of soap and it is unnecessary because of the incorporation by reference of the previous three patents to which recite again the operation of the internal aspects of the soap dispenser 100.

Suffice it to say that the actuator 200 which includes both slidable and pivotable portions cooperates with the pumping mechanism 165 and particularly the bowl or bulb 185 to dispense discrete doses of soap in a manner consistent with the American Disabilities Act and which facilities use by the handicapped.

While there has been disclosed what is considered to be the preferred embodiment of the present invention, it is understood that various changes in the details may be made without departing from the spirit, or sacrificing any of the advantages of the present invention.

What is claimed is:

1. A dispenser for liquid soap comprising a soap container, a slidable and pivotable actuating means connected to said soap container, and pumping means carried by said soap container for emitting discrete charges of liquid soap from a fluid outlet in communication with said pumping means, said actuating means disposed for contact with said pumping means for effecting operation thereof, whereby sliding and pivoting movement of said actuating means from a rest position to a dispensing position at not greater than five pounds of pressure dispenses discrete doses of soap from said pumping means.

2. The dispenser of claim 1, wherein said pumping means includes a flexible bulb which when filled with soap and compressed dispenses a discrete dose of soap from said fluid outlet, said actuating means including a slidable bar extending outwardly from said soap container which when pushed by a user causes compression of said bulb.

3. The dispenser of claim 2, wherein said slidable bar moves between said rest position wherein said bar extends outwardly beyond said soap container and to said dispensing position wherein said bulb is compressed, movement out of said slidable bar to said dispensing position occurs when said bar is slidably moved toward the rear of said soap container and still extends beyond the front of said soap container and said bulb is compressed to dispense soap from said outlet.

4. The dispenser of claim 2, wherein said actuating means has portion thereof pivotally mounted in communication with said slidable portion.

5. A system for dispensing liquid soap comprising a closed wall structure defining a container, partition means separating said container into a separate lower liquid soap reservoir and a separate upper refill compartment, dispensing means carried by said container for dispensing liquid soap from said reservoir, said partition means having a refill aperture therethrough providing communication for soap flow between said reservoir and said refill compartment and dimensioned to permit the free flow of liquid soap therethrough, a refill cartridge containing liquid soap and having an outlet, said refill cartridge being removably enclosed within said refill compartment in a refill configuration with said outlet disposed for cooperation with said refill aperture to permit the free flow of liquid soap from said refill cartridge to said reservoir thereby to refill said reservoir as liquid soap is dispensed therefrom, and actuating means slidably mounted on said container in pivotable contact with said dispensing means, said actuating means being slidable between a rest position and a dispensing position such that not greater than five pounds of pressure is sufficient to move said actuating means between the rest and dispensing positions thereof.

6. The system of claim 5, wherein a slidable portion of said actuating means carries a pair of prongs thereon for engagement with a pivotable portion thereof movable by said slidable portion to cause said dispensing means to dispense a discrete dose of soap.

7. A refillable liquid soap dispenser adapted for use with a soap refill cartridge containing liquid soap and having an outlet, said dispenser comprising a closed wall structure defining a container, partition means dividing the interior of said container into a separate lower liquid soap reservoir and a separate upper refill compartment, dispensing means carried by said soap container for dispensing liquid soap from said container, and actuating means slidably mounted on said container in pivotable contact with said dispensing means, said actuating means slidable between a rest position and a dispensing position, said actuating means in both positions thereof having a horizontally positioned bar member extending beyond said container for easy access by the handicapped and being movable between position with not greater than five pounds of pressure, said partition means having a refill aperture therethrough providing the exclusive communication for soap flow between said refill compartment and said reservoir and dimensioned readily to permit the flow of liquid soap from said refill compartment to said reservoir, said refill compartment being dimensioned to enclose the associated refill cartridge in a refill configuration with the outlet thereof disposed for cooperation with said refill aperture to permit the free flow of liquid soap from the refill cartridge to said reservoir thereby to refill said reservoir as liquid soap is dispensed therefrom.

8. The dispenser of claim 7, wherein said dispensing means includes a pumping mechanism having a flexible bulb which when filled with liquid soap and compressed dispenses a discrete dose of soap.

9. The dispenser of claim 8, wherein said bar member of said actuating means is slidably mounted with respect to said soap container and said actuating means has a portion thereof pivotally mounted in communication with said slidable bar member.

10. The dispenser of claim 9, wherein said slidable bar member is in communication with opposed journals receiving stub shafts extending from said pivotable portion, said pivotable portion has a spherical part which compresses said bulb when said slidable portion is in the dispensing position thereof.

* * * * *